US006020577A

United States Patent [19]

Barker

[11] Patent Number: 6,020,577

[45] Date of Patent: Feb. 1, 2000

[54] ELECTRIC HEATING ELEMENT SUPPORT STRUCTURES AND METHOD OF MAKING SAME

[75] Inventor: Carl E. Barker, St. Louis County, Mo.

[73] Assignee: Industrial Engineering and Equipment Company, St. Louis, Mo.

[21] Appl. No.: 09/008,668

[22] Filed: Jan. 19, 1998

[51] Int. Cl.[7] ..... H05B 3/06; H01C 1/01; H01C 10/14

[52] U.S. Cl. ..... 219/537; 338/315; 338/317; 338/318; 219/536

[58] Field of Search ..... 219/537, 478, 219/536; 341/209; 338/315, 317, 318, 316, 305; 392/350, 347

[56] References Cited

U.S. PATENT DOCUMENTS

| | | | |
|---|---|---|---|
| 1,077,658 | 11/1913 | Vogel | 338/317 |
| 1,119,841 | 12/1914 | Kuhn . | |
| 1,234,670 | 7/1917 | Jones | 338/317 |
| 1,247,286 | 11/1917 | Kuhn et al. . | |
| 1,307,198 | 6/1919 | Harth | 219/536 |
| 1,320,155 | 10/1919 | Kuhn et al. | 338/317 |
| 1,398,168 | 11/1921 | Bakstad | 338/317 |
| 1,433,465 | 10/1922 | Lightfoot | 338/302 |
| 1,590,477 | 6/1926 | Mottlau . | |
| 1,628,858 | 5/1927 | Shawk . | |
| 1,628,875 | 5/1927 | Ehrgott . | |
| 1,628,876 | 5/1927 | Ehrgott . | |
| 2,226,781 | 12/1940 | Rutenber . | |
| 2,712,588 | 6/1955 | Epstein | 219/34 |
| 3,092,705 | 6/1963 | Roussan et al. | 219/19 |
| 3,560,708 | 2/1971 | Fox . | |
| 3,641,312 | 2/1972 | Ammerman et al. | 219/532 |
| 3,800,263 | 3/1974 | Ammerman et al. . | |
| 3,812,322 | 5/1974 | Osterkorn et al. | 219/532 |
| 3,869,789 | 3/1975 | Yungblut et al. . | |
| 3,883,721 | 5/1975 | Paulson et al. | 219/532 |
| 3,952,409 | 4/1976 | Allison et al. . | |
| 4,363,959 | 12/1982 | Cottrell et al. . | |
| 4,617,547 | 10/1986 | Howard et al. | 338/317 |
| 4,656,340 | 4/1987 | St. Louis . | |
| 4,692,599 | 9/1987 | Howard et al. . | |
| 5,124,534 | 6/1992 | Williams et al. . | |

*Primary Examiner*—John A. Jeffery
*Assistant Examiner*—Daniel L. Robinson
*Attorney, Agent, or Firm*—Polster, Lieder, Woodruff & Lucchesi, L.C.

[57] ABSTRACT

A structure is provided for supporting at least one heating element inside an electric heater housing. To produce the support structure, a web is cut out of a metal sheet that includes a rectangular member, one or more support brackets and a neck portion connecting each support bracket to one side of the rectangular member. The support rail is formed by bending the rectangular along its longitudinal median into an L-shape configuration with a first portion integrally formed with a second portion in a perpendicular relationship. The first portion is secured to the electric heater housing. The second portion extends inwardly in the electric heater housing. The neck portions extend inwardly from the second portion, and are twisted approximately 90° with respect to the support rail. The support brackets extend inwardly from each neck portion. Each support bracket has one or more openings formed therein, each adapted to receive electrical insulating means, such as coil bushings. The heating elements are inserted through the insulating means to electrically isolate the heating element from the support bracket. Means also is provided for securing said insulating means within the opening of said support bracket.

8 Claims, 7 Drawing Sheets

ELECTRIC HEATING ELEMENT SUPPORT STRUCTURES AND METHOD OF MAKING SAME

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates to electric heaters, and in particular to a structure for supporting heating elements or coils in an electric heater such as an open coil beater. The present invention also includes methods for making such a support structure. While the invention is described with particular reference to open coil heaters, those skilled in the art will recognize the wider applicability of the inventive principles disclosed hereinafter. For example, this invention finds application in the heating and air conditioning field, and is useful in devices such as heat pumps, fan coil units, or combined heating and cooling air conditioners.

Open coil electric heaters typically include structures that support heating elements in a stacked or spaced parallel relationship with respect to other coils in the heater. The heating elements are operably connected to a terminal box assembly including control circuitry that selectively energizes the heating elements. Often separate support structures are used to individually position each heating element within the heater. Alternatively, complex support structures have been designed that can support multiple coils within the heater. Construction and assembly of such support structures typically require complicated and expensive manufacturing procedures, and involved installation procedures that further add to the cost of the heater. For example, each support structure typically includes a plurality of brackets having one or more heating coils threaded through openings formed therein. Construction of support structures employing such brackets increases manufacturing costs since the brackets are positioned axially along a support rail, and then individually attached to the rail.

Therefore, it is desirable to design a support structure for a multicoil heater that minimizes manufacturing and installation costs. Preferably, the support structure is constructed from a single piece of sheet metal, thereby requiring a minimal number of components and allowing for a high level of automation during manufacture and assembly of the unit. This construction also should be able to withstand heat stress and vibrations to which the support structure may be exposed during transportation, assembly and operation, as well as high terminal box ambients generated by abnormal conditions. It is further desirable that the coils can be easily threaded through the support structure. Additionally, the support structure should be readily mounted in the heater assembly to permit simple connection of the heating coils to the control circuitry.

BRIEF SUMMARY OF THE INVENTION

Accordingly, one object of the present invention is to provide a new and improved structure for supporting heating coils in an electric heater.

Another object of this invention is to provide a support structure for an electric heater that is economical and easy to manufacture.

Still another object of this invention is to provide a support structure for an electric heater constructed from a single piece of sheet metal.

Yet another object of this invention is to provide a support structure that allows for heating elements to be easily inserted therein, and that can be readily installed in an electric heater assembly.

These and other objects will become apparent to those skilled in the art in light of the following disclosure and accompanying drawings.

In accordance with the invention, generally stated, a structure is provided for supporting at least one heating element inside an electric heater housing. The support structure includes a support rail adapted for mounting in the electric heater housing. The support rail has a first portion disposed at a substantially right angle with respect to a second portion. The first portion is secured to the electric heater housing, and the second portion extends inwardly in the electric heater housing. The support structure also includes one or more neck portions integrally formed with and extending inwardly from the second portion. A support bracket is integrally formed with each neck portion such that each support bracket extends inwardly from each neck portion. Each support bracket has one or more openings formed therein. Insulating means is disposed in each opening of the support bracket to electrically isolate the heating element from the support bracket. The support structure also includes means for securing the insulating means within the opening of the support bracket.

Another aspect of the present invention is the provision of a method for producing a structure for supporting one or more heating elements associated with an electric heater, comprising the steps of: forming from a single sheet of metal a web which includes a substantially rectangular rail portion, one or more neck portions spaced longitudinally along and extending independently upwardly from one side of the rail portion and a support bracket portion extending upwardly from each neck portion; forming at least one opening in each support bracket; bending a segment of the rail portion approximately 90° along a longitudinal median of the rail portion to define a substantially L-shaped configuration; and twisting said neck portion approximately 90° with respect to said rail portion.

Other objects and features will be apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

In the drawings.

Corresponding reference characters indicate corresponding parts throughout the several views of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
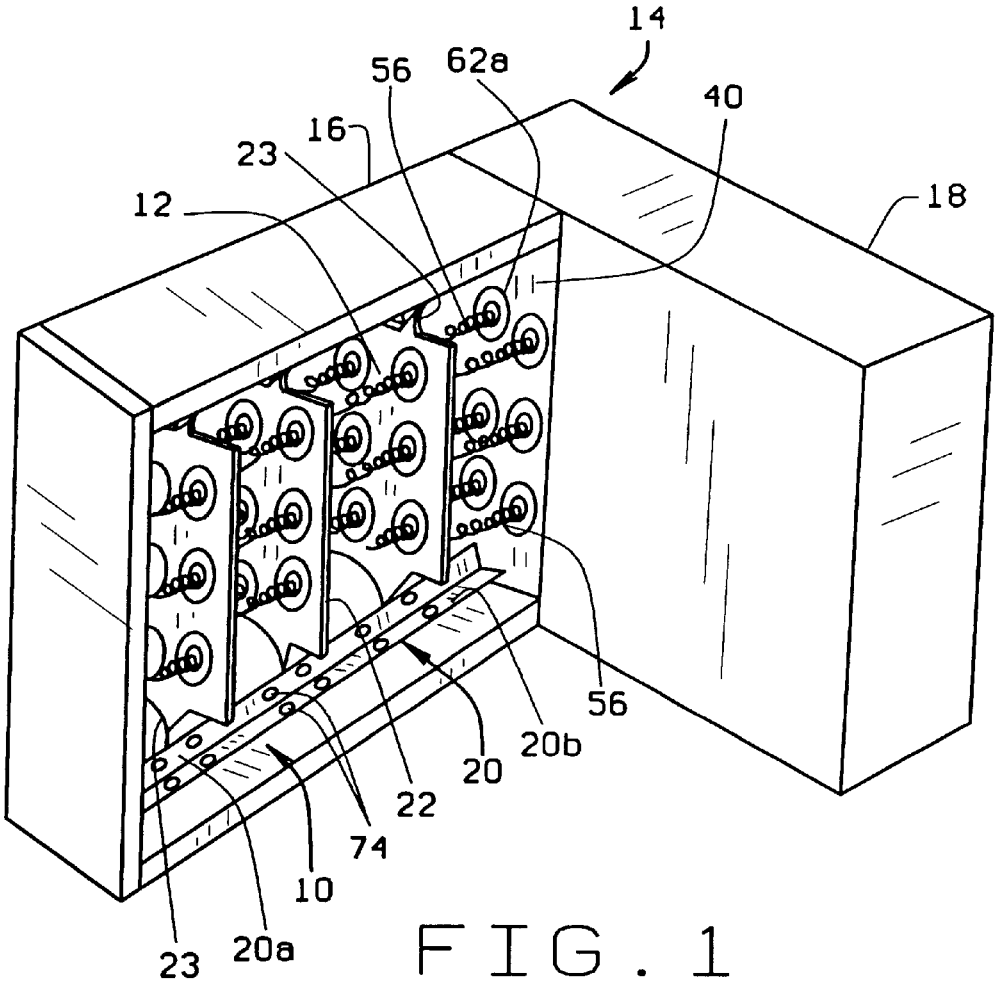
FIG. 1 is a perspective view of an open coil heater assembly having one embodiment of the support structure of the present invention mounted therein.
Figure 2:
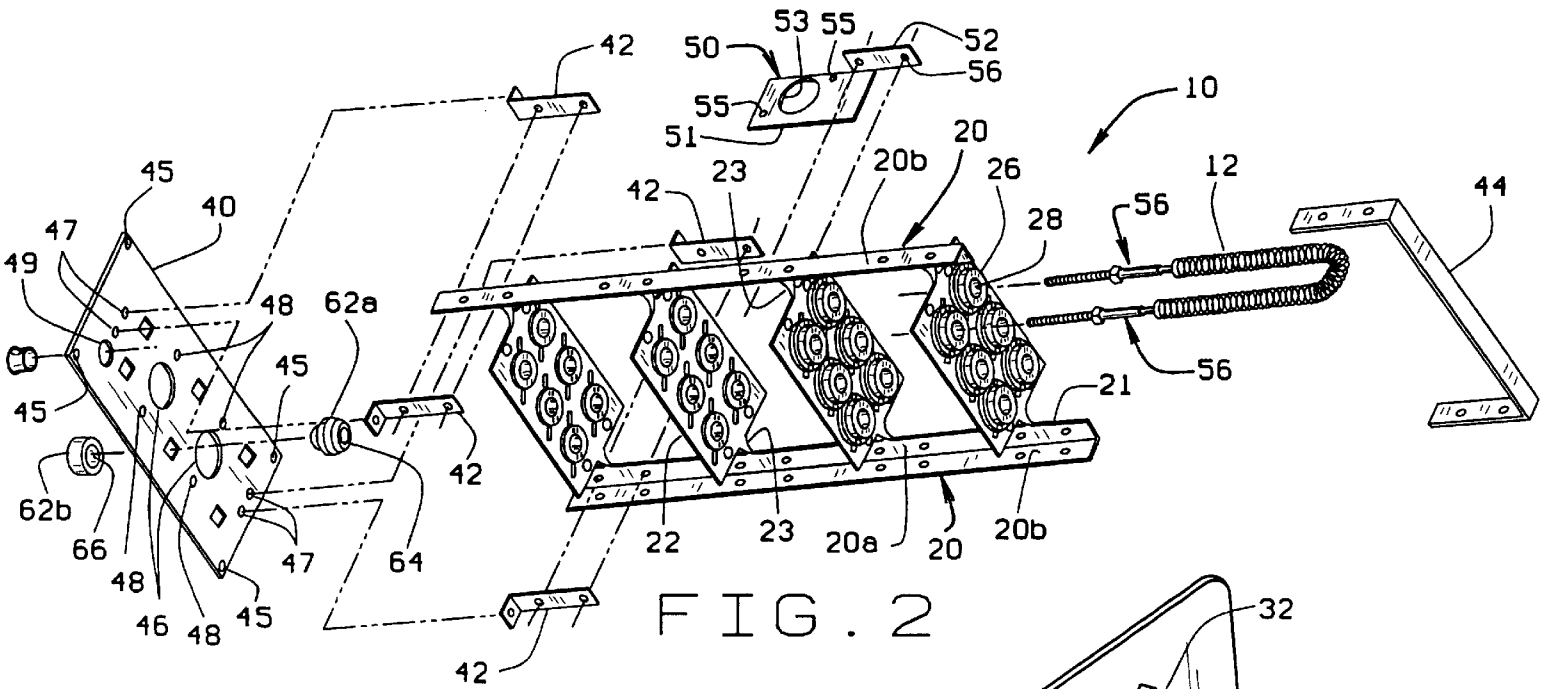
FIG. 2 is an exploded perspective view showing the interconnection of a heating coil and terminal plate to a second embodiment of the support structure.

Referring now to the drawings, and in particular to FIGS. 1 and 2, a support structure 10 is shown, referred to generally by reference numeral 10, for supporting one or more heating elements or coils 12 associated with an electric heater 14 such as, for example, an open coil heater. The electric heater 14 generally includes a housing frame 16 in which the heating elements 12 and one or more support structures 10 are disposed. In the preferred embodiment, the frame 16 is constructed from a heavy gauge, corrosion resistant material such as galvanized steel, stainless steel or aluminized steel. As will be appreciated by those skilled in the art, the frame 16 is mounted to a terminal box 18 as shown generally in FIG. 1 that contains conventional electrical circuitry components (not shown) that control the operation of the electric heater 14.

Each support structure 10 is formed from a web 70 (hereinafter described with reference to FIGS. 7A–7E), and includes at least one support rail 20 having two integrally formed flanges 20*a*, 20*b* bent into a substantially L-shape as shown in FIG. 2. As discussed below, the flange 20*b* acts as a base for the support structure 10 that is secured to the housing frame 16 upon assembly of the heater 14. A plurality of support brackets 22 extend outwardly from an inwardly extending side 21 of the flange 20*a*. The support brackets 22 are attached to the support rail 20 by a neck portion 23 that is twisted approximately 90° during construction of the support structure 10 (see discussion below). Twisting the neck portion 23 provides improved mechanical strength to the support structure assembly 10 by preventing movement of the support brackets 22 relative to the support rails 20.

Figure 3:
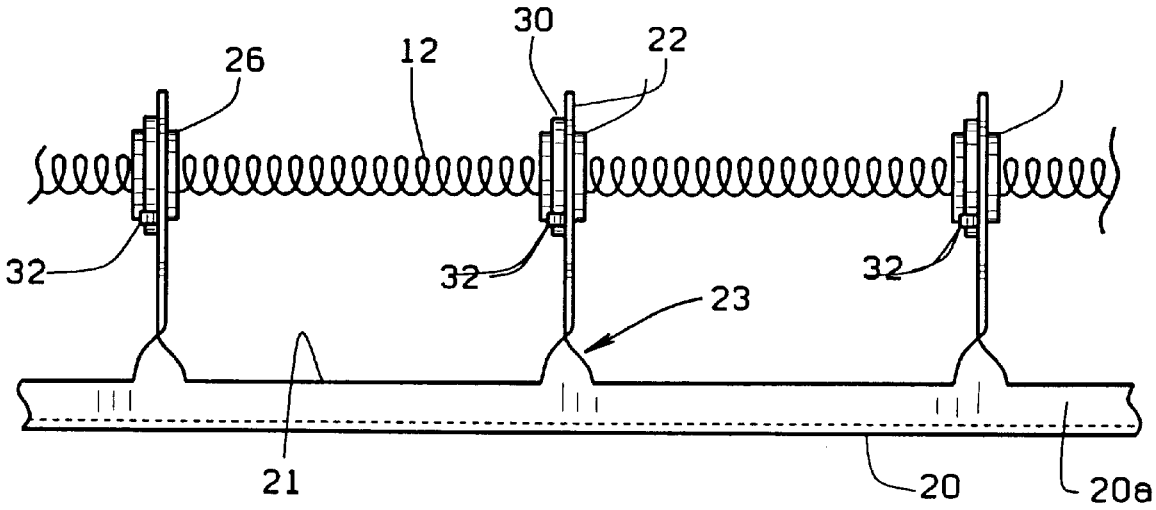
FIG. 3 is a fragmentary sectional side elevational view of a third embodiment of the support structure having a heating coil inserted therethrough.
Figure 5:
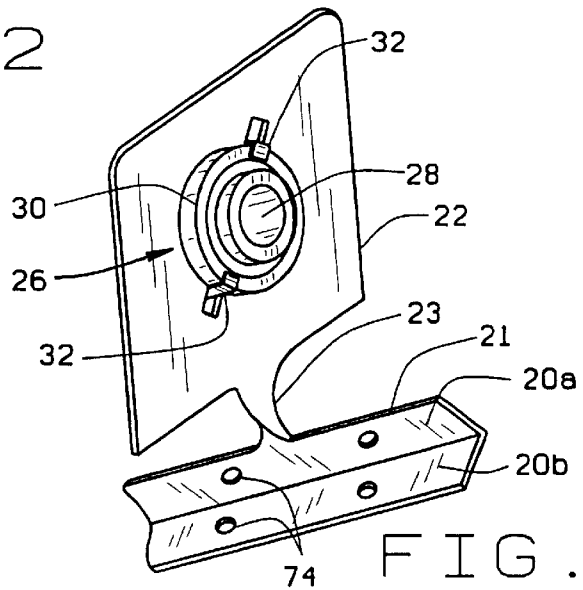
FIG. 5 is a perspective view of the support structure of FIG. 3, having the heating coil removed to illustrate the mounting of the coil bushing to the support bracket by the mounting retaining clips.
Figure 4:
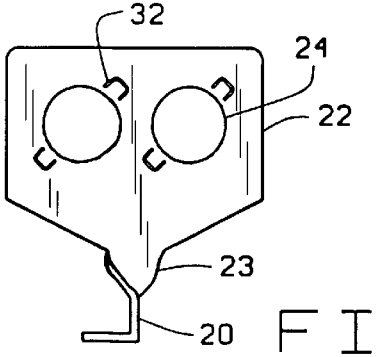
FIG. 4 is a front elevational view of a fourth embodiment of the support structure.

Each support bracket 22 has one or more openings 24 (FIG. 4) formed therein. The openings 24 are adapted to receive a portion of an electrical insulator coil bushing 26 (FIGS. 5 and 3). The coil bushings 26 have a substantially cylindrical shape with an opening 28 extending axially therethrough that is adapted to receive one of the heating elements 12 therein. Each coil bushing 26 preferably includes a radially outwardly extending collar 30 that is adapted for engagement with the support bracket 22 when the coil bushing 26 is inserted in the opening 24 (see FIGS. 2, 3 and 5). The collar 30 prevents axial movement of the coil bushing 26 through the opening 24. The collar 30 is secured to the bracket 22 by a pair of retaining clips or tabs 32 that are formed in each bracket 22 at each bushing opening 24. During assembly of the support structure 10, the retaining clips 32 are bent into engagement with the collar 30 as shown in FIGS. 2, 3 and 5. The retaining clips 32 prevent the coil bushings 26 from becoming dislodged from the openings 24 in the support brackets 22.

The number of heating coils 12 supported by each support bracket 22 can vary, based upon the design requirements of a particular heating system. For example, the support structure 10 shown in FIGS. 3 and 5 is designed to support one substantially straight heating coil 12. FIG. 1 shows another illustrative embodiment of the support structure 10 of the present invention that is adapted to support three U-shaped coils 12. Alternatively, the support structure 10 of FIG. 1 can support up to six substantially straight heating coils 12. In comparing FIG. 1 to FIGS. 3 and 5, it is apparent that the number of openings and dimensions of the support brackets 22 associated with the present invention can vary to accommodate any desired number of heating elements 12, or heating elements 12 of various shapes.

As shown in FIGS. 2, 7C, 7D and 7E, a second support rail 20 can be included in the support structure 10 to provide additional support for the structure 10 when mounted inside the housing 16. The two support rails 20 preferably have the same overall dimensions. As discussed above with respect to the single rail embodiment, the second support rail 20 also has two flanges 20*a*, 20*b* integrally formed in a substantially L-shaped configuration, and is secured to the support bracket 22 by a second neck portion 23 that is twisted approximately 90° to provide improved mechanical strength.

Each support rail 20 preferably is secured at one end to a terminal plate 40 as shown in FIG. 2. The terminal plate 40 facilitates the connection of end terminal pins 56 of the heating coil 12 to the circuitry in the terminal box 18 by providing support and guidance to the end terminal pins 56. While any fastening mechanism can be used to secure the support rails 20 to the terminal plate 40, the preferred embodiment employs a pair of mounting strips 42 that are attached to each support rail 20 and the terminal plate 40 using pop-rivets. When U-shaped coils 12 are used, an end angle or channel 44 can be secured to the opposite ends of the support rails 20 as shown in FIG. 2 to protect the coils 12 from damage during assembly, transportation or operation of the heater 14. The support structure 10 also can be attached to an external frame member (not shown), if present, via the end angle 44. For example, as will be appreciated by those skilled in the art, in an air duct mounted heater such as a flange heater, the external frame member of the heater includes a top, bottom and end pan ("D" pan) that are flanged for attachment to the air duct. More specifically, two sections air duct terminates at opposite sides of the heater frame such that the heater frame effectively becomes a short section of the air duct between the two sections. When the support structure 10 is installed into the external frame member for flange mounting, the end angle 44 attaches to the "D" pan of the external frame member to support the end of the heater, thereby becoming a "D" pan support channel.

The terminal plate also includes a plurality of openings 45, 46, 47, 48 and 49 formed therein as shown in FIGS. 2 and 6A–6F. Openings 45 are used to attach the terminal plate 40 to the back side of the terminal control box 18 to which the heater is mounted. Openings 47 allow for attachment of the support structure 20 to the terminal plate 40. Openings 49 allow for mounting of a snap-in wire protection bushing (not shown) through which electrical wires from the ARTCO temperature control limit switch (discussed below) pass.

Openings 46 of the terminal plate 40 are sized to accommodate bi-metal disc type high temperature limit switches (not shown) that are commonly associated with electric heaters. As is known in the art, an approved UL/CSA heater includes two temperature limit control switches, namely an automatic reset temperature control (ARTCO) switch that typically operates first and a manual reset temperature control (MRTCO) switch that provides a back up to the ARTCO switch. The openings 46 are adapted to receive the MRTCO switches, and expose the bi-metal discs associated with the MRTCO switches to temperatures inside the heater coil area. Fastening mechanisms (not shown) are inserted through openings 48 to attach and retain the MRTCO switches in openings 46.

The ARTCO switch (not shown) is mounted over the coils 12 by a mounting bracket 50 (FIG. 2). The mounting bracket includes a substantially flat base 51, and a flange 52 integrally formed with and extending perpendicularly from an edge of the base 51 as shown in FIG. 2. The base 51 of the mounting bracket 50 has an opening 53 and a pair of openings 55 formed therein, where opening 53 is sized to receive the ARTCO switch, and openings 55 are adapted to accommodate fastening mechanisms (not shown) that securely attach the ARTCO switch to the mounting bracket 50. The mounting bracket 50 is attached to the support rail 20 at a desired location by fastening mechanisms (not shown) that are inserted through openings 56 formed in the flange 52 of the bracket 50, and corresponding openings formed in the support rail 20. The ARTCO mounting bracket 50 can be interspersed between the coil support brackets 22 to allow the ARTCO bi-metal disc type temperature control to be mounted at various locations along the length of the heater as required by the particular application. Ideally, airflow over the heater coils 12 is uniform from end to end, top to bottom. However, often this is not the case due to obstructions such as a filter frame or cooling coil header, or a turn in the air duct that causes airflow to be nonuniform. The mounting bracket 50 and support rail 20 designs allow for the ARTCO switch to be mounted to the support structure 10 at a desired position where airflow is uniform to avoid nuisance tripping of the switch.

Figure 6A:
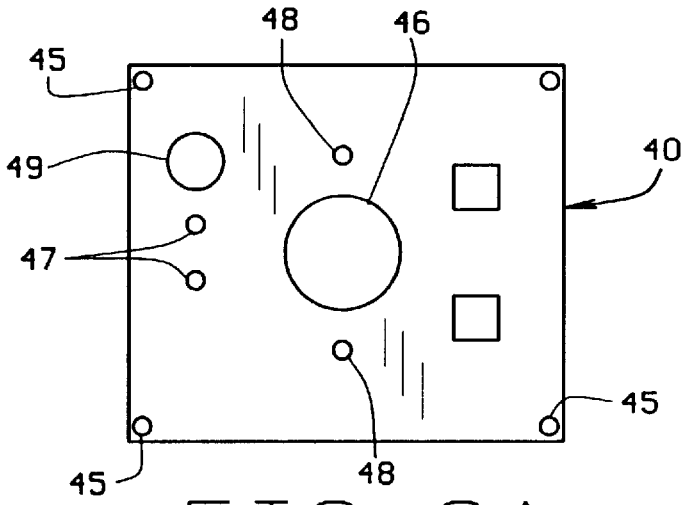
FIG. 6A is top plan view of a first embodiment of the terminal plate.
Figure 6B:
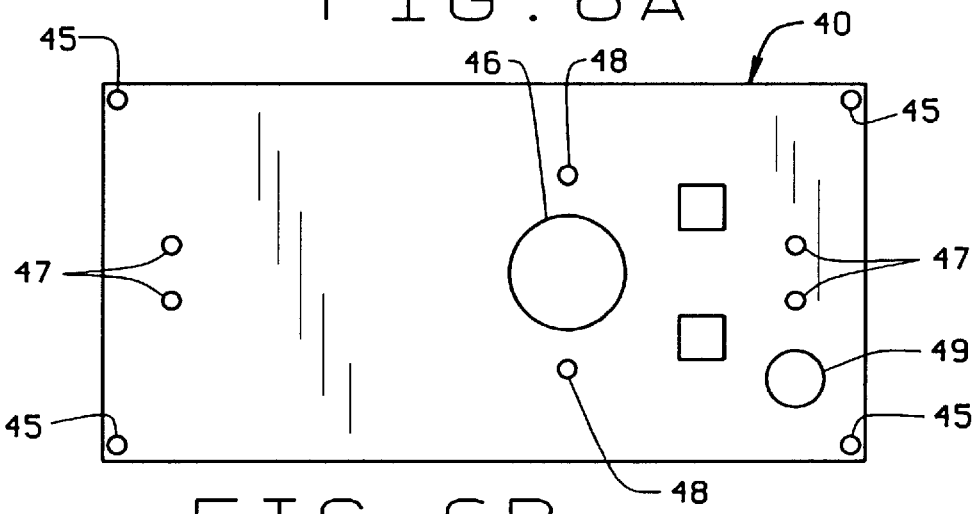
FIG. 6B is top plan view of a second embodiment of the terminal plate.
Figure 6C:
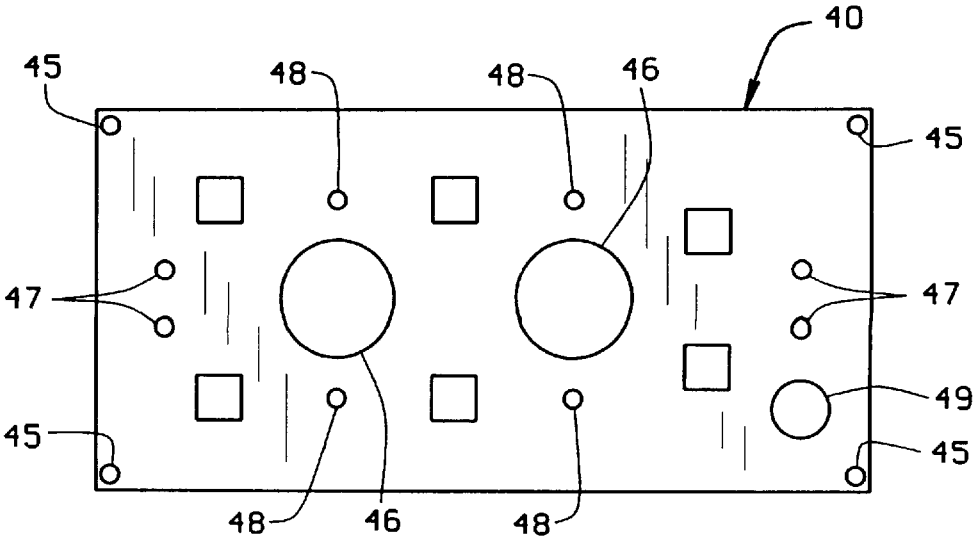
FIG. 6C is top plan view of a third embodiment of the terminal plate.
Figure 6D:
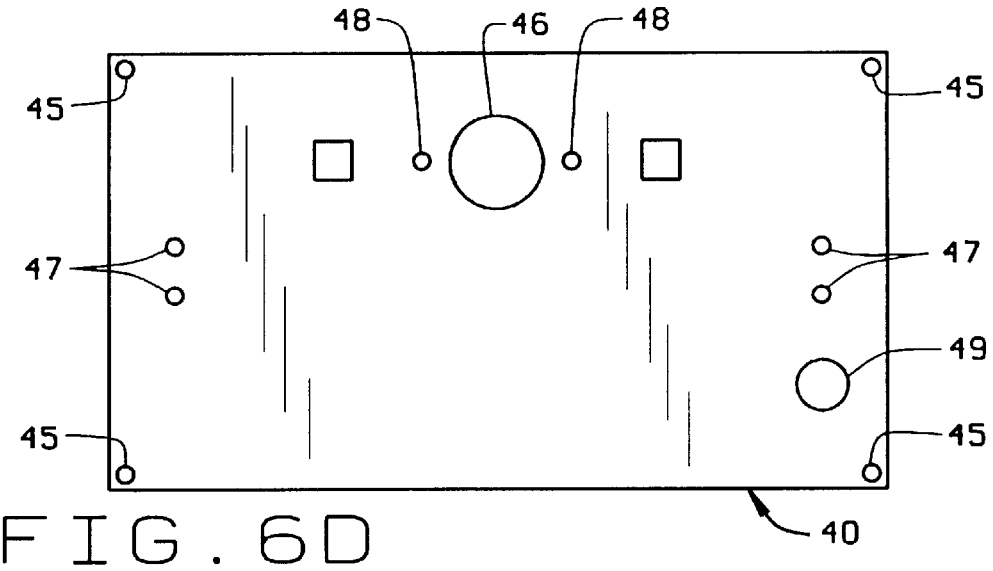
FIG. 6D is top plan view of a fourth embodiment of the terminal plate.
Figure 6E:
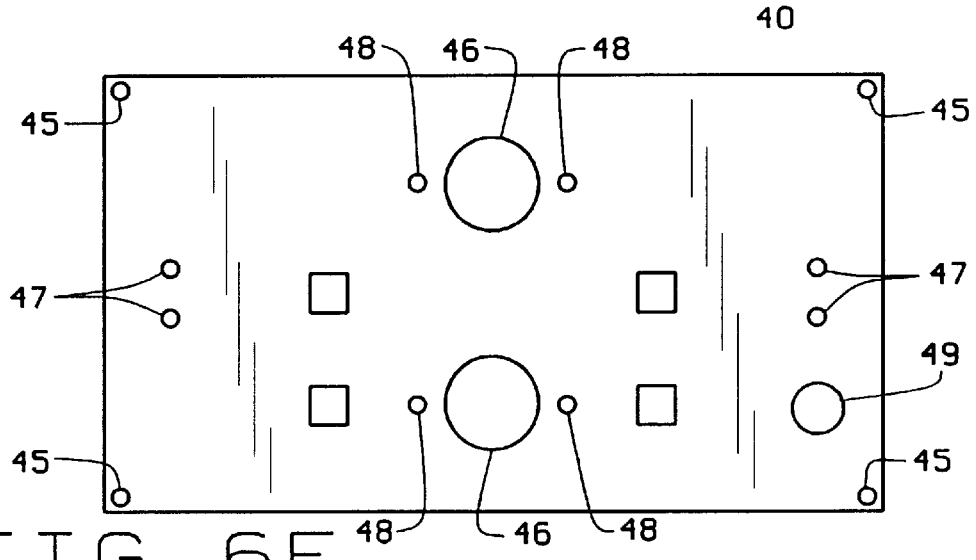
FIG. 6E is top plan view of a fifth embodiment of the terminal plate.
Figure 6F:
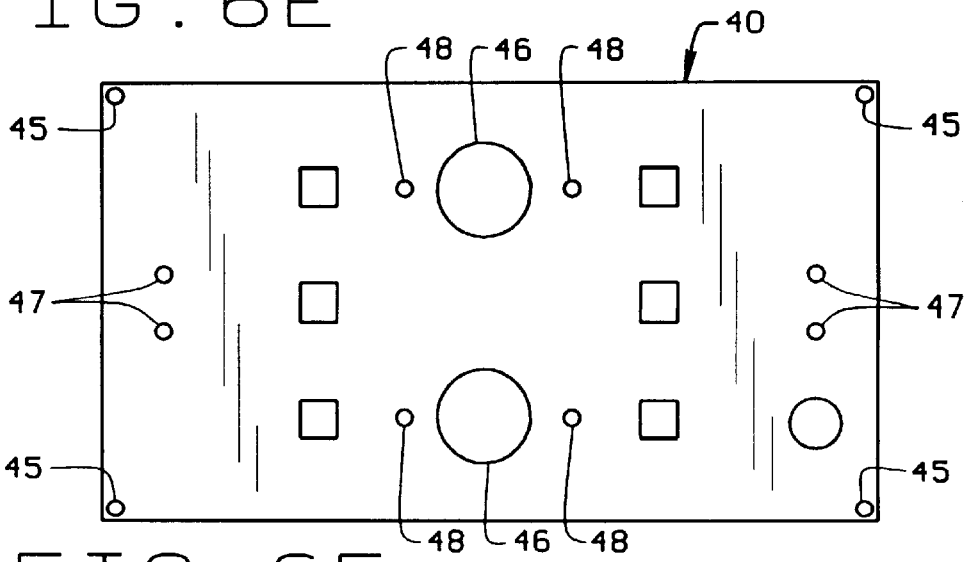
FIG. 6F is top plan view of a sixth embodiment of the terminal plate.

The terminal plate 40 preferably is constructed from 18 gauge galvanized steel. FIGS. 6A–6F set forth illustrative embodiments of terminal plates 40 for several types of heater assemblies 14. For example, FIG. 6A shows the design of one embodiment of terminal plate 40 that is used in conjunction with a support structure 10 employing two coil bushings 26 to support one U-shaped heating coil 12; FIG. 6B shows a terminal plate 40 design for a support structure 10 employing six coil bushings 26 to support one U-shaped heating coil 12 in a single phase heating assembly 14; FIG. 6C shows a terminal plate 40 design for a support structure 10 employing six coil bushings 26 to support three heating coils 12 in a three phase heater assembly 14; FIG. 6D shows a terminal plate 40 design for a support structure 10 employing twelve coil bushings 26 to support one coil 12 making twelve passes in a single phase heater assembly 14; FIG. 6E shows a terminal plate 40 design for a support structure 10 employing twelve coil bushings 26 to support two coils 12 making six passes in a single phase heater assembly 14; and FIG. 6F shows a terminal plate 40 design for a support structure 10 employing twelve coil bushings 26 to support three coils 12 making four passes in a three phase heater assembly 14.

When the support structure 10 is secured to the terminal plate 40, end terminal pins 56 associated with each coil 12 extend outwardly from the support structure 10 through openings 60 formed in the terminal plate 40. The terminal pins 56 are electrically isolated from the terminal plate 40 by terminal bushings 62 as shown in FIG. 2. More specifically, a male terminal bushing 62*a* is positioned in the opening 60 formed in the terminal plate 40. The male terminal bushing 62*a* has an opening 64 extending therethrough which is adapted to receive one of the terminal pins 56 during heater assembly. A female terminal bushing 62*b* is positioned on the opposite side of the terminal plate 40 with respect to the male terminal bushing 62*a*. The female terminal bushing 62*b* is designed to be matingly engaged with the male terminal bushing 62*a* upon assembly of the heater 14 such that the terminal bushing 62 is securely retained within the opening 60 of the terminal plate 40. More specifically, the female terminal bushing 62*b* has an opening 66 formed therethrough that is adapted to receive the portion of the end terminal pin 56 extending outwardly from the terminal plate 40 (see FIG. 2).

The web portions 70 of the support structures 10 are constructed from a single piece of sheet metal, preferably 22 gauge galvanized steel. Since the support brackets 22 are integrally formed with the support rails 20, it is not necessary to position and physically attach each support bracket 22 to the support rail 20. Highly automated manufacturing processes are used to produce the web 70 of the support structure 10 of the present invention. In the preferred embodiment, an automated punch press assembly punches the web 70 such as that shown in FIG. 7A from a single piece of sheet metal. Alternatively, the web 70 can be punched from automatically fed strip stock in a punch press using dedicated permanent tooling. This method can be used for high volume standard patterns. The web also can be punched out of sheet stock on a computerized numerical control (CNC) turret punch press. The CNC turret punch press operate more slowly than the standard punch press, but provides increase flexibility since it utilizes standard punches and tooling, and can be of any size within the CNC punch press limit of horizontal and vertical travel dimensions. Another alternative for making the web is to cut the pattern or web out of a blank instead of punching it out, using any of a number of cutting methods such as a CNC laser or water jet, or even by hand using normal tin snips.

As discussed above, the web 70 design varies based upon the requirements of the particular heater assembly 14. Depending upon the particular application, the web 70 generally includes one or more coil support brackets 22, one or more neck portions 23 and one or two support rails 20 in the flat for each support structure 10. The web 70 also is provided with mounting and clearance holes or openings 24, 72, 74. Openings 24 are adapted to receive coil support ceramic bushings therein. If desired, openings 72 as shown in FIGS. 7A–7E can be included in the web design to allow for insertion of an optional linear temperature limit control capillary (not shown) therein. The temperature sensing capillary is strung through the openings 72 across the length of the heater so that the capillary can sense when a high temperature condition occurs at any location along the length of the heater. Openings 74 allow for mounting of the ARTCO mounting bracket 50 to the web, as discussed above, in a plurality of possible mounting locations to overcome possible airflow variations associated with a particular application.

Figure 7A:
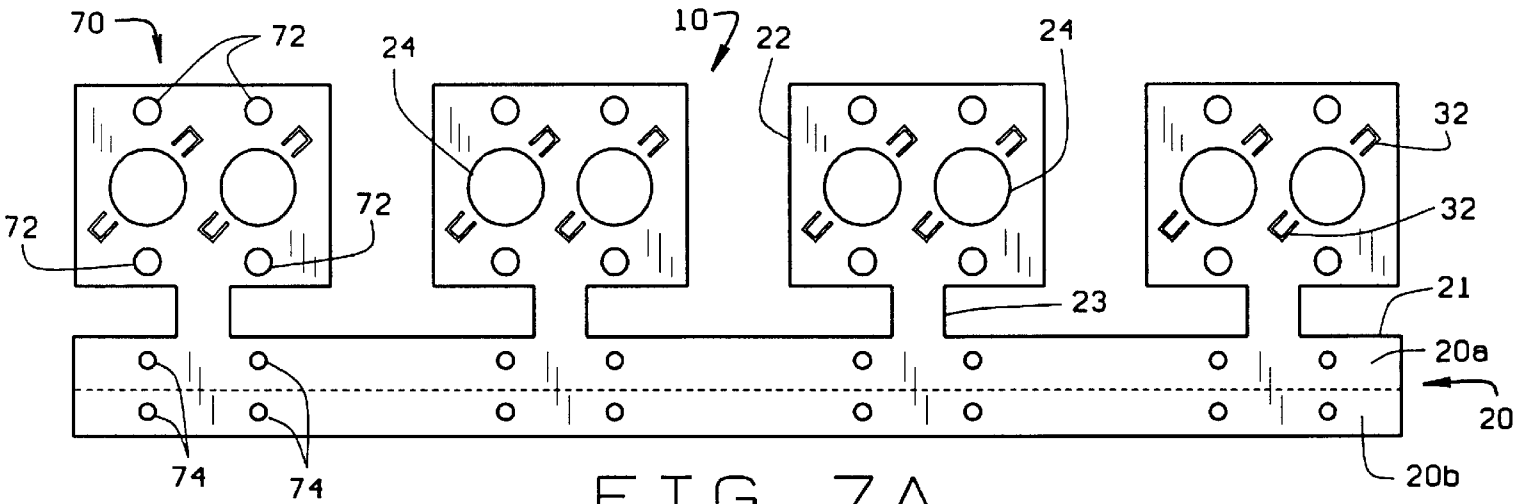
FIG. 7A is a top plan view of a first embodiment of the support structure web.
Figure 7B:
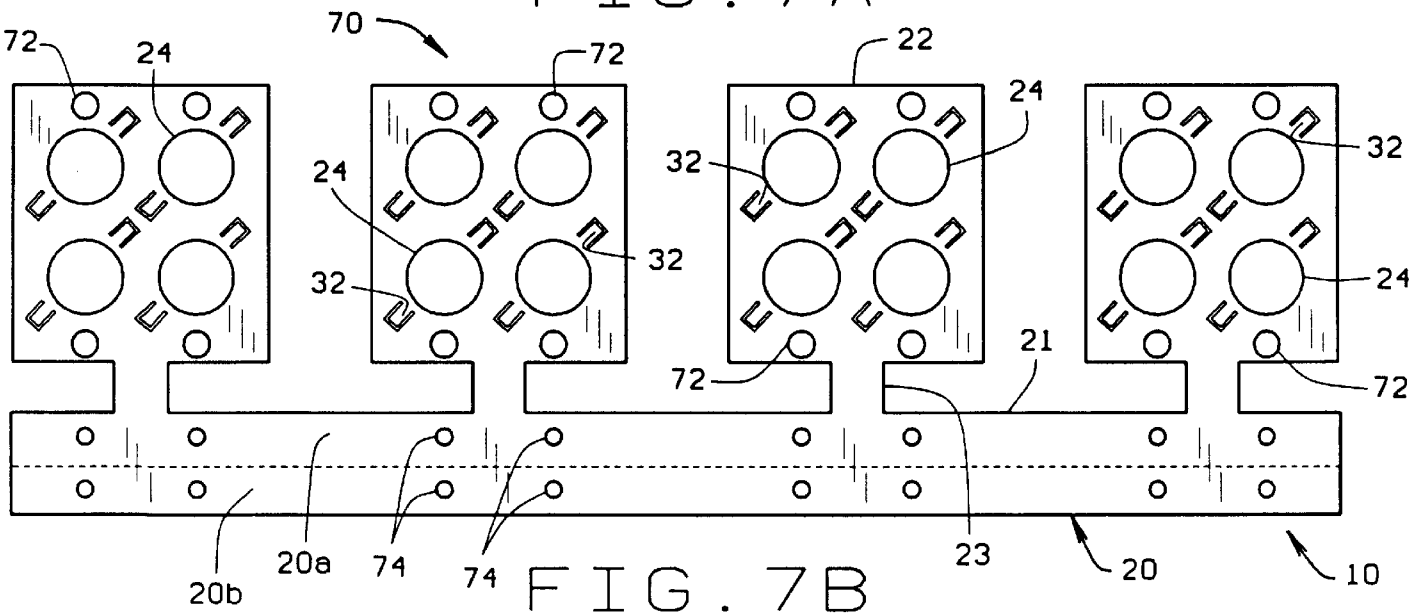
FIG. 7B is a top plan view of a second embodiment of the support structure web.
Figures 7C, 7D:
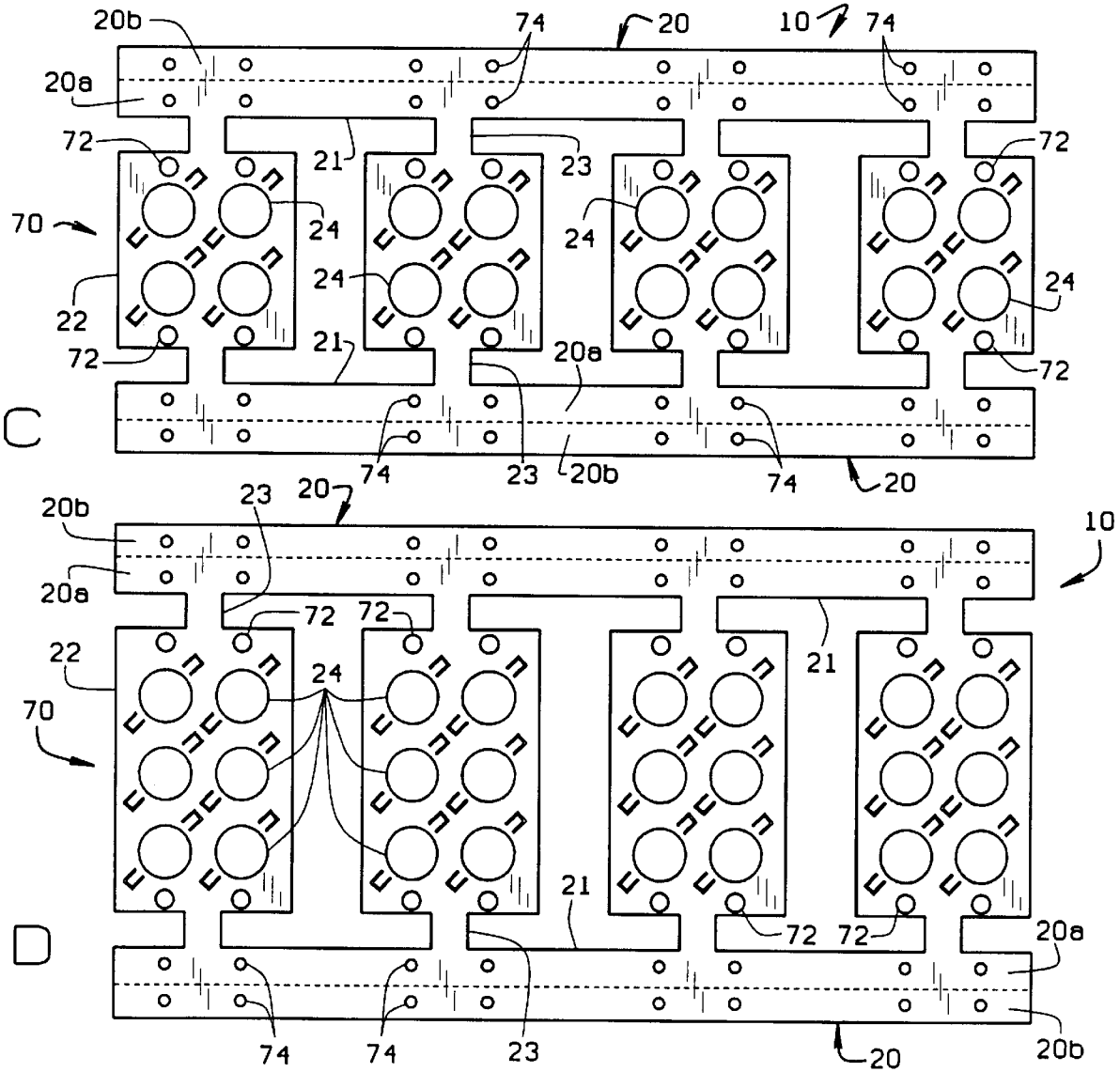
FIG. 7C is a top plan view of a third embodiment of the support structure web.
FIG. 7D is a top plan view of a fourth embodiment of the support structure web.
Figure 7E:
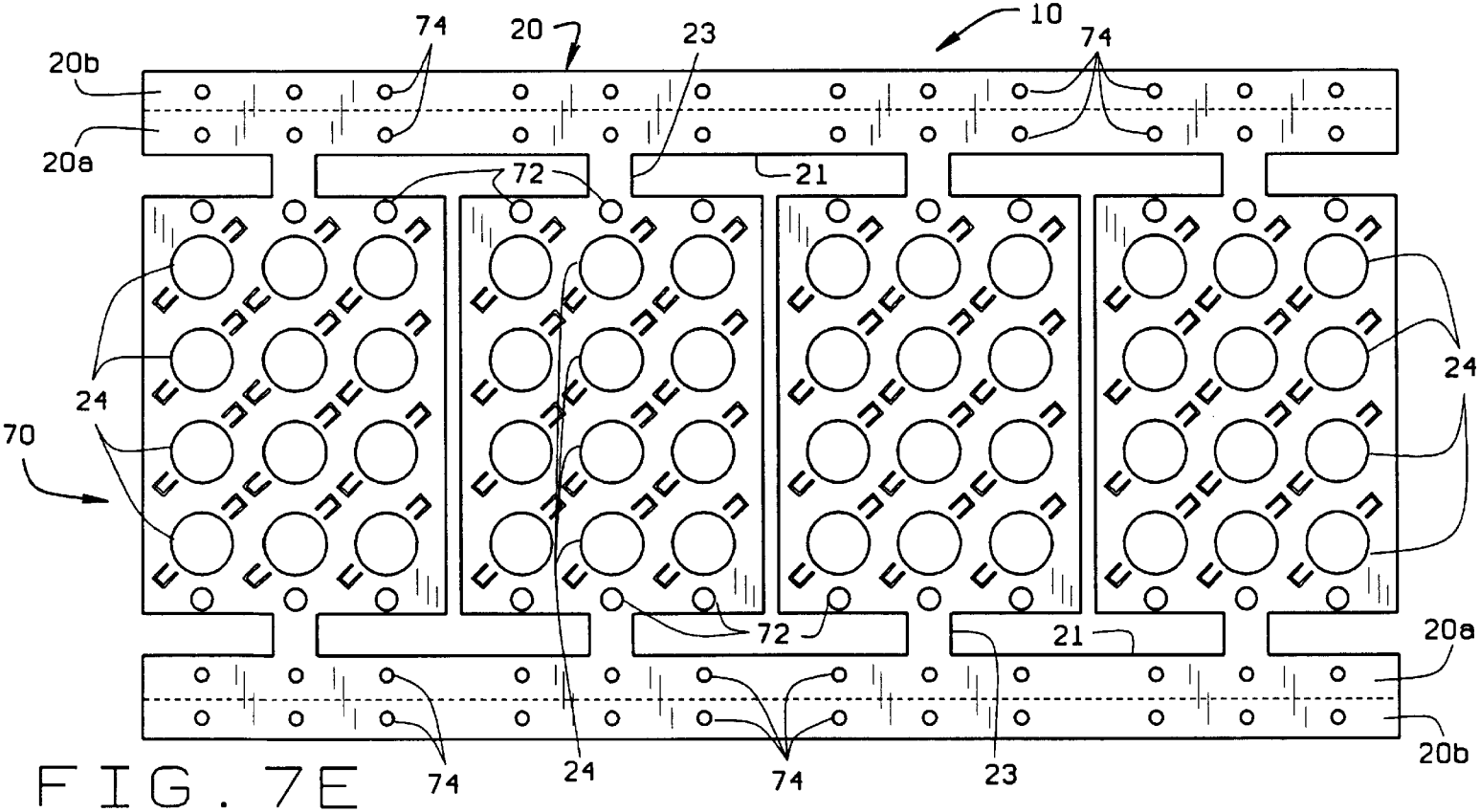
FIG. 7E is a top plan view of a fifth embodiment of the support structure web.
Figure 9:
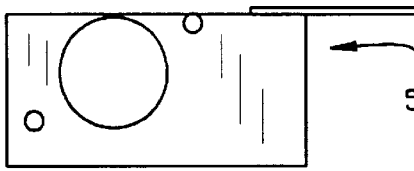
FIG. 9 is a top plan view of the mounting bracket of FIG. 8.
Figure 10:
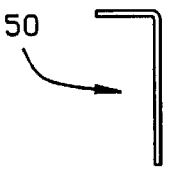
FIG. 10 is a side elevational view of the mounting bracket of FIG. 8.
Figure 8:
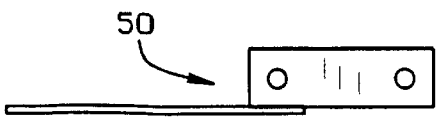
FIG. 8 is a front elevational view of a mounting bracket.

For example, FIG. 7A shows a web 70 having a single support rail 20, four support brackets 22, two bushing openings 24 formed in each bracket 22 and die cuts defining a pair of retaining clips 32 formed at each bushing opening 24; FIG. 7B shows a web 70 having a single support rail 20, four support brackets 22 and four busing openings 24 in each bracket 22; FIG. 7C shows a web 70 having two support rails 20, four support brackets 22 and four bushing openings 24 in each bracket 22; FIG. 7D shows a web 70 having two support rails 20, four support brackets 22 and six bushing openings 24 in each bracket 22; and FIG. 7E shows a web 70 having two support rails 20, four support brackets 22 and twelve bushing openings 24 in each bracket 22. In the preferred embodiment, standard web 70 patterns that are used repeatedly are formed using coiled strip metal and hard tooling on a standard punch press. Custom or specially designed web 70 patterns are formed using sheet metal stock on a CNC turret punch press that has all of its punches and tools loaded into stations in a rotating turret.

After the web 70 is punched, the support rail 20 for the web 70 is cut to a desired length based upon the requirements and dimensions of the heater 14. The coil bushings 26 are inserted into the openings formed in the support brackets 22, and staked in place by bending the metal retaining clips 32 cut in the support brackets 22 into engagement with the collars 30 of the coil bushings 26. The flanges 20*a*, 20*b* of the support rail 20 are bent into the "L" shape to define the rail support as shown in FIG. 2. The coil support brackets 22 are twisted 90° with respect to the support rail 20 such that the neck portion 23 takes on its twisted shape as shown in FIGS. 2–5. By bending support rail 20 and twisting the neck portions 23, the support structure 10 becomes a three dimensional frame that is entirely self supporting and has improved mechanical strength.

After the coil bushings 26 are secured to the support brackets 22 and the support structure 10 is properly constructed, the heating coils 12 are threaded through the coil bushings 26 in the desired fashion. The coil end terminals 56 and support structure 10 then are attached to the terminal plate 40, and the mounting brackets 50 are attached to the support structure 10. As will be appreciated by those skilled in the art various components associated with the heater assembly 14 can be disposed at multiple locations with respect to the support structure 10. For example, the terminal plate 40 can be located at either end of the support rail(s) 20, or attached to an outer side of one of the two flanges 20*a*, 20*b* comprising the L-shaped support rail 20.

In view of the above, it will be seen that the several objects and advantages of the present invention have been achieved and other advantageous results have been obtained.

The foregoing description is set forth only for illustrative purposes only and is not meant to be limiting. As various changes could be made in the above constructions without departing from the scope of the invention, it is intended that all matter contained in the above description or shown in the accompanying drawings shall be interpreted as illustrative and not in a limiting sense. Numerous variations, within the scope of the appended claims will be apparent to those skilled in the art in light of the foregoing description and accompanying drawings.

I claim:

1. A structure 10 for supporting at least one heating element 12 inside an electric heater housing 14, comprising:

an integrally formed web 70 including at least one support rail 20 adapted for mounting in the electric heater housing 14, said support rail 20 including a first portion 20*b* disposed at a substantially right angle with respect to a second portion 20*a*, said first portion 20*b* being secured to the electric heater housing, said second portion 20*a* extending outwardly from the electric heater terminal housing, said web further including a plurality of neck portions 23 integrally formed with and extending inwardly from said second portion 20*a*, said neck portions 23 being twisted at a substantially 90° angle with respect to said second portion 20*a*, and a substantially flat support bracket 22 having opposing planar surfaces integrally formed with and extending inwardly from each neck portion 23, each support bracket having one or more openings 24 formed therein; and a substantially cylidrical insulating coil bushing 26 disposed in each opening 24 of said support bracket 22 to electrically isolate the heating element 12 from the support bracket 22, said support bracket 22 further including means 32 for securing said coil bushing 26 within the opening 24 of said support bracket 22.

2. The support structure of claim 1 wherein said insulating coil bushing includes a tubular body portion extending through the opening 24 in said support bracket 22, and a collar portion extending radially outwardly from said body portion and being maintained in abutment with one of said planar surfaces of said support bracket 22 when said body portion is positioned inside the opening 24.

3. The support structure of claim 2 wherein said securing means 32 includes a pair of retaining clips formed in said support bracket 22, said retaining clips being adapted for bendable engagement with said collar portion of said coil bushing, said retaining clips engaging a top surface of said collar portion of said coil bushing 26 to retain said body portion in the opening 24 and the collar portion in abutment with the planar surface of the support bracket 22.

4. An integrally formed structure for supporting a plurality of heating elements in an electric heater housing formed from a single sheet of metal, comprising:

a pair of substantially parallel, spaced apart longitudinally bent support rails, each support rail including a first flange integrally formed with a second flange in a substantially perpendicular relationship, said first flanges being adapted to be secured to opposing sides of the electric heater housing;

a plurality of substantially flat support brackets integrally formed with and extending between said second flange of each support rail, each support bracket having opposing planar surfaces and a plurality of openings formed therethrough;

a plurality of coil bushings each having a tubular body portion with an opening extending therethrough that is adapted to receive a portion of the heating coil, and a collar extending radially outwardly from one end of said body portion, one coil bushing being positioned inside each opening of said support brackets such that said body portion extends through said opening and said collar is maintained in abutment with one of the planar surfaces of said support bracket, said collar of said coil bushing being securely held in engagement with said support bracket.

5. The structure of claim 4 wherein said said collar of said coil bushing is held in engagement with said support bracket by a pair of bendable retaining clips formed in said support bracket in the vicinity of each opening, said retaining clips being bent into engagement with a top surface of said collar to secure said collar to said support bracket within said opening.

6. The structure of claim 4 wherein said support brackets are secured to said support rail by an integrally formed twisted neck portion.

7. An electric heater, comprising:

one or more heating elements;

a housing having said heating elements disposed therein;

electrical circuitry disposed in said housing and operably connected to said heating elements for selectively energizing said heating elements;

a support structure disposed inside said housing for supporting said heating elements therein, said support structure being integrally formed from a single sheet of metal, and said support structure including an L-shaped support rail having a first flange removably secured to said housing and a second flange extending inwardly from said first flange into said housing in a substantially perpendicular fashion, one or more neck portions integrally formed with and extending inwardly from said second flange, and a support bracket integrally formed with and extending inwardly from each neck portion, each support bracket having one or more openings formed therein; and an electrical insulator disposed in each opening of said support brackets, said insulator having an opening formed therein, said opening being adapted to receive therethrough a portion of said heating element.

8. The electric heater as set forth in claim 7, further including a terminal plate mounted in said housing between said support structure and said circuitry, said terminal plate having one or more openings formed therein, said openings in said terminal plate being adapted to receive and support a portion of said heating elements.

* * * * *

UNITED STATES PATENT AND TRADEMARK OFFICE

CERTIFICATE OF CORRECTION

PATENT NO : 6,020,577

DATED : February 1, 2000

INVENTOR(S) : Carl E. Barker

It is certified that error appears in the above-identified patent and that said Letters Patent are hereby corrected as shown below:

Col. 1, line 16
replace "beater"
with --heater--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*